US008746320B2

(12) United States Patent
Yu et al.

(10) Patent No.: US 8,746,320 B2
(45) Date of Patent: Jun. 10, 2014

(54) WINDOW COVERING WITH IMPROVED CONTROLS

(75) Inventors: Fu-Lai Yu, Taipei Hsieh (TW); Chin-Tien Huang, Taipei Hsieh (TW)

(73) Assignee: Teh Yor Co., Ltd., Taipei (TW)

( * ) Notice: Subject to any disclaimer, the term of this patent is extended or adjusted under 35 U.S.C. 154(b) by 63 days.

(21) Appl. No.: 12/660,448

(22) Filed: Feb. 26, 2010

(65) Prior Publication Data

US 2011/0209836 A1 Sep. 1, 2011

(51) Int. Cl.
*E06B 9/322* (2006.01)

(52) U.S. Cl.
USPC ..... 160/170; 160/300

(58) Field of Classification Search
USPC ..... 160/291–300, 305, 309, 313, 168.1 R, 160/173 R, 170 R, 177 R, 178.1 R, 84.04, 160/84.05, 171, 170; 192/216, 58.3; 188/296, 307
See application file for complete search history.

(56) References Cited

U.S. PATENT DOCUMENTS

| | | | | |
|---|---|---|---|---|
| 4,498,517 | A * | 2/1985 | Mase | 160/294 |
| 6,666,252 | B2 * | 12/2003 | Welfonder | 160/296 |
| 6,789,598 | B2 * | 9/2004 | Nien | 160/172 R |
| 6,854,503 | B2 * | 2/2005 | Cross et al. | 160/168.1 R |
| 6,854,505 | B2 * | 2/2005 | Grubb et al. | 160/296 |
| 7,624,785 | B2 * | 12/2009 | Yu et al. | 160/171 |
| 2009/0020239 | A1 * | 1/2009 | Yu et al. | 160/331 |
| 2009/0255637 | A1 * | 10/2009 | Yu et al. | 160/331 |
| 2009/0321022 | A1 * | 12/2009 | Yu et al. | 160/84.05 |

FOREIGN PATENT DOCUMENTS

| | | | |
|---|---|---|---|
| EP | 356403 | A1 * | 2/1990 |
| JP | 2001027083 | | 1/2001 |

OTHER PUBLICATIONS

PCT International Search Report PCT/US2010/000573 (4 pp.).
PCT Written Opinion PCT/US2010/000573 (7 pp.).
PCT International Search Report PCT/2010/000573 (2 pages).
PCT Written Opinion PCT/2010/000573 (7 pages).
Extended European Search Report (9 pages).

* cited by examiner

*Primary Examiner* — David Purol
(74) *Attorney, Agent, or Firm* — Olson & Cepuritis, Ltd.

(57) ABSTRACT

A window covering with improved controls enhances several aspects of window covering operation. A control mechanism provides a clutch module for selective locking and unlocking of a drive shaft used to retract and extend the shade element between storage and extended positions. The clutch module includes a reciprocator element that engages a key extending from an outer surrounding housing. A locking member between the reciprocator element and a coupling element carried by the drive shaft selectively locks and unlocks rotational coupling between the reciprocator element and the coupling element, thus selectively locking and unlocking the drive shaft. In a cushioning mechanism, a unidirectional dampening or frictional deceleration is provided for the drive shaft. The cushioning mechanism includes an impeller or rotor immersed in a cushion medium that impedes rotation of the rotor, and hence the drive shaft to which the rotor is coupled. A combination of the clutch module and cushioning mechanism is also disclosed as are window coverings containing one or more of the control mechanisms.

20 Claims, 23 Drawing Sheets

WINDOW COVERING WITH IMPROVED CONTROLS

TECHNICAL FIELD OF THE INVENTION

This invention relates to an improved control mechanism for window coverings. In particular, this invention relates to a control mechanism including a clutch module and a cushioning mechanism for window coverings to provide improvements in window covering operations.

BACKGROUND OF THE INVENTION

Window coverings come in a variety of styles and sizes. Examples of such window coverings may include Roman shades, Venetian blinds and cellular shades. One feature common to many window coverings is the ability of the shade element to be deployed in a number of different operating positions either fully or partly covering a window opening. In the case of the listed window coverings, the shade elements are typically suspended by way of cords from a head rail and are retracted by winding the cords on a winding drum or roller, which may be mounted on a drive axle. Winding of the cords is accomplished by causing the cords to be wound on the winding drum or roller, and thereby raising the shade element. More particularly, the suspension cords are connected to a bottom rail or bottom member, and raising of the bottom member raises the shade element. The shade element is deployed by rotating the roller in an opposite direction so as to unwind increasing amounts of the shade element with each counter rotation. A control mechanism is typically provided to control operation of the window covering.

For a variety of reasons, including safety concerns and aesthetics, efforts have been expended to eliminate the use of operating cords and wands. The Assignee of the present invention has contributed significant improvements in providing control mechanisms which do not require the use of external operating cords and wands. These and other features are described in U.S. Pat. No. 7,624,785 entitled "self-raising window covering" that issued Dec. 1, 2009, which is incorporated herein by reference. Despite advances in the art of so-called cordless control mechanisms, there is a need to improve operation of a window covering at intermediate positions that is compatible for use with self-raising window coverings.

In the case of a self-raising window covering, a drive unit, such a spring motor, may be operatively connected to the drive axle. Typically, a coil spring is charged either initially, prior to operation, or as the shade element is pulled free of the roller causing the roller to rotate in a counter direction. A problem often encountered with self-raising window coverings, however, relates to the controlled operation of the vertical position of the window covering. In some instances, the force exerted by the spring motor on the winding drum may not be properly balanced with the suspended weight of the shade element. Such imbalances may result in unintended drift, either upwards or downwards, of the window shade element.

Attempts to address these problems have included the incorporation of a clutch member or locking member. One example is found in the assignees co-pending patent application Ser. No. 12/584,229, which is incorporated herein by reference. As a window covering is raised, the amount of shade element being raised increases. For example, in a Venetian blind, as the slats are stacked on a bottom rail during raising, the overall weight being lifted increases. Because of this, the spring motor must provide sufficient force to raise increasing amounts of weight, and often requires a relatively strong spring motor. This spring motor may tend to exert excessive stress on the clutch of locking member, thereby causing undue wear or unintended slippage.

SUMMARY OF THE INVENTION

The present invention relates to a control mechanism for a cordless window covering. The present invention provides novel and improved control mechanisms for window coverings that minimize the disadvantages associated with the prior art devices and provides advantages in construction, mode of operation and use.

Generally speaking, window coverings are installed within architectural openings by way of a top member, such as a head rail mounted to the top portion of the architectural opening. In some instances, the head rail may be eliminated and control elements may be attached directly to the top portion of the opening. For ease of description, the present invention will be described with an embodiment utilizing a head rail. In a typical window covering, a shade element, such as an expandable cellular panel, a plurality of Venetian blind slats, or a Roman shading element, is suspended from the head rail by way of one or more suspension cords.

The head rail defines a central axis that extends across the width of the architectural opening. Mounted parallel to the central axis within the head rail is a rotatable drive axle. Preferably, one or more winding drums are mounted to the drive axle so as to rotate along with the drive axle. First ends of the suspension cords are connected to the winding drums, and second ends of the cords are connected to a bottom member or bottom rail. In order to open the window covering, one raises the shade element by rotating the drive axle in a first direction so as to cause the suspension cords to be wound on the winding drums. As the suspension cords are wound on their respective winding drums, the bottom member or bottom rail is raised and the shade element is gathered on the bottom member or bottom rail, thereby opening the window covering. By causing the drive axle to rotate in a second direction opposite to the first direction, the suspension cords are unwound such that the bottom rail is lowered and the shade element is extended.

The present invention relates particularly to an improved control module for the window covering which provides for more robust and secure locking of the window covering in a desired position. The control module is preferably provided for mounting within the head rail about the drive shaft. A spring drive element may be included to cause rotation of the drive axle in the first direction, although other means for rotating the drive axle may be used.

The control module includes a housing that may have a generally rectangular shape for convenient assembly in the head rail. The housing includes a key or protrusion associated therewith, as well as a sidewall. The sidewall includes a gripping structure, such as cogs. A coupling element is provided for circumferentially mounting about the drive axle, and a reciprocator is circumferentially mounted about the coupling element. The coupling element is configured to move axially relative to the drive axle, and includes a second gripping structure that enables selective engagement with the sidewall of the housing, thereby restricting rotation of the drive axle in the first direction. Disengagement of the coupling element from the sidewall allows the drive axle to rotate in both the first and second directions. The operation of a preferred embodiment of the control module will be discussed later.

In some embodiments, an adapter sleeve may be mounted directly to the drive axle, such that the coupling element and reciprocator are mounted about the adapter sleeve. Also, a locking member, such as a coil spring, may be circumferentially mounted between the coupling element and the reciprocator. The adapter sleeve may be available in various configurations such that similarly configured control modules may be mounted on drive shafts of different configurations.

As discussed, the coupling element is preferably carried by the sleeve for rotation therewith and for axial translation back and forth relative to the drive shaft. The reciprocator element is disposed about the coupling element. The reciprocator element defines a guide track for receiving and engaging the key and maintaining engagement with the key as the reciprocator element selectively moves with respect to the key. The reciprocator element is limited by the interaction between the guide track and the key to a specific range of movement, both rotationally and axially, which selectively causes the second gripping surface of the coupling element to engage the first gripping surface of the housing.

In a preferred embodiment, the locking member is provided between the reciprocator element and the coupling element to selectively lock the reciprocator element with the coupling element for common rotational movement therewith, and to unlock the reciprocator element for independent rotational movement with respect to the coupling element. While the coupling element and the reciprocator are selectively enabled to rotate relative to each other, they do not change axial positions relative to each other for reasons that will be discussed below with respect to the preferred embodiments of the invention.

The present invention also provides a cushioning mechanism that operates to provide a unidirectional rotational dampening of an adjacent module, such as one containing the control mechanism referred to immediately above. The cushion mechanism includes a rotor containing an impeller with directional arms, and a body coupled to the drive shaft of the adjacent module. The cushioning mechanism provides for smoother raising of the window covering. The cushioning mechanism also assist in avoiding uncontrolled raising of the window covering, which could otherwise result in damage to the control mechanism.

BRIEF DESCRIPTION OF THE DRAWINGS

FIGS. 11A-15A are top plan views of the control mechanism according to the present invention, shown in different operating configurations;

FIGS. 11B-15B show the guide elements of FIGS. 11A-15A, respectively;

FIGS. 16A-20A are perspective views of another embodiment of a control mechanism according to the present invention, shown in different operating configurations;

FIGS. 16B-20B are cross-sectional views taken through FIGS. 16A-20A, respectively;

DESCRIPTION OF THE PREFERRED EMBODIMENTS

Figure 1:
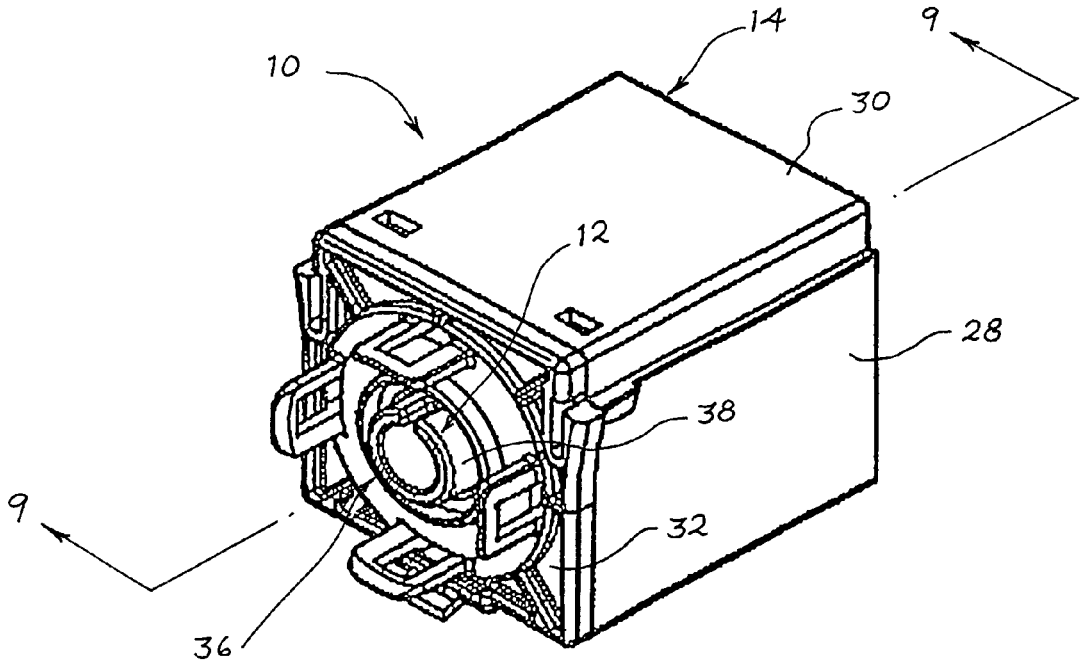
FIG. 1 is a perspective view of a control module according to a preferred embodiment of the present invention.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments.

For ease of description, control mechanisms for window coverings embodying the present invention is described herein below in their usual assembled position as shown in the accompanying drawings, and terms such as upper, lower, horizontal, longitudinal, clockwise, counter clockwise, etc., may be used herein without reference to this usual position. However, the control mechanisms may be manufactured, transported, sold or used in orientations other than and described and shown herein.

An apparatus embodying the present invention provides control mechanisms for controlling operation of window coverings having a variety of shade elements, such as Roman shades, Venetian blinds and cellular shades. The shade elements are operated between a retracted, storage position and an extended position at least partly covering a window opening. In general, the mechanism for operating the shade element includes a drive shaft that is driven in opposite rotational directions. The control mechanisms of the present invention, in one aspect, provide a clutch module to control operation of the drive shaft to which a shade element is coupled through a winding drum for retracting or extending one or more raising cords. The control mechanisms according to the present invention provide control over operation of the drive shaft to control retraction or extension of the shade element to either open or block a window opening.

In one example, the control mechanisms selectively permit or block rotation of the drive axle shaft in both a first and second direction, thereby controlling the position of the shade element. In some embodiments, the control mechanisms according to the present invention may also include a cushioning component along with the clutch module to provide smoother acting positive operation of the window covering. In other aspects, the present invention provides improved control mechanisms for self-raising window coverings which operate according to a reciprocator element.

Referring now to the drawings, and initially to FIGS. 1-15, an actuator control mechanism according to a preferred embodiment of the present invention is generally indicated at 10. FIG. 1 shows a clutch module 12 disposed within a housing 14. The clutch module 12 is comprised of various parts, which are described in detail below. FIG. 5 shows the clutch module 12 with housing 14 drawn in phantom. The clutch module 12 is mounted on a drive axle 20 that extends along a longitudinal drive axis 22. While in this embodiment, the drive axle 20 is coaxial with the drive axis 22, this is not required. As will be seen herein, the clutch module 12 can selectively engage with a sidewall 32 portion of housing 14 to selectively block or unblock rotation of drive shaft 20. Although not shown in the Figures, it should be understood that the shade element is extended or retracted in response to rotation of drive shaft 20 in opposite directions. The manner in which the shade element is extended or retracted is controlled by the clutch module 12 according to the present invention.

Figure 2:
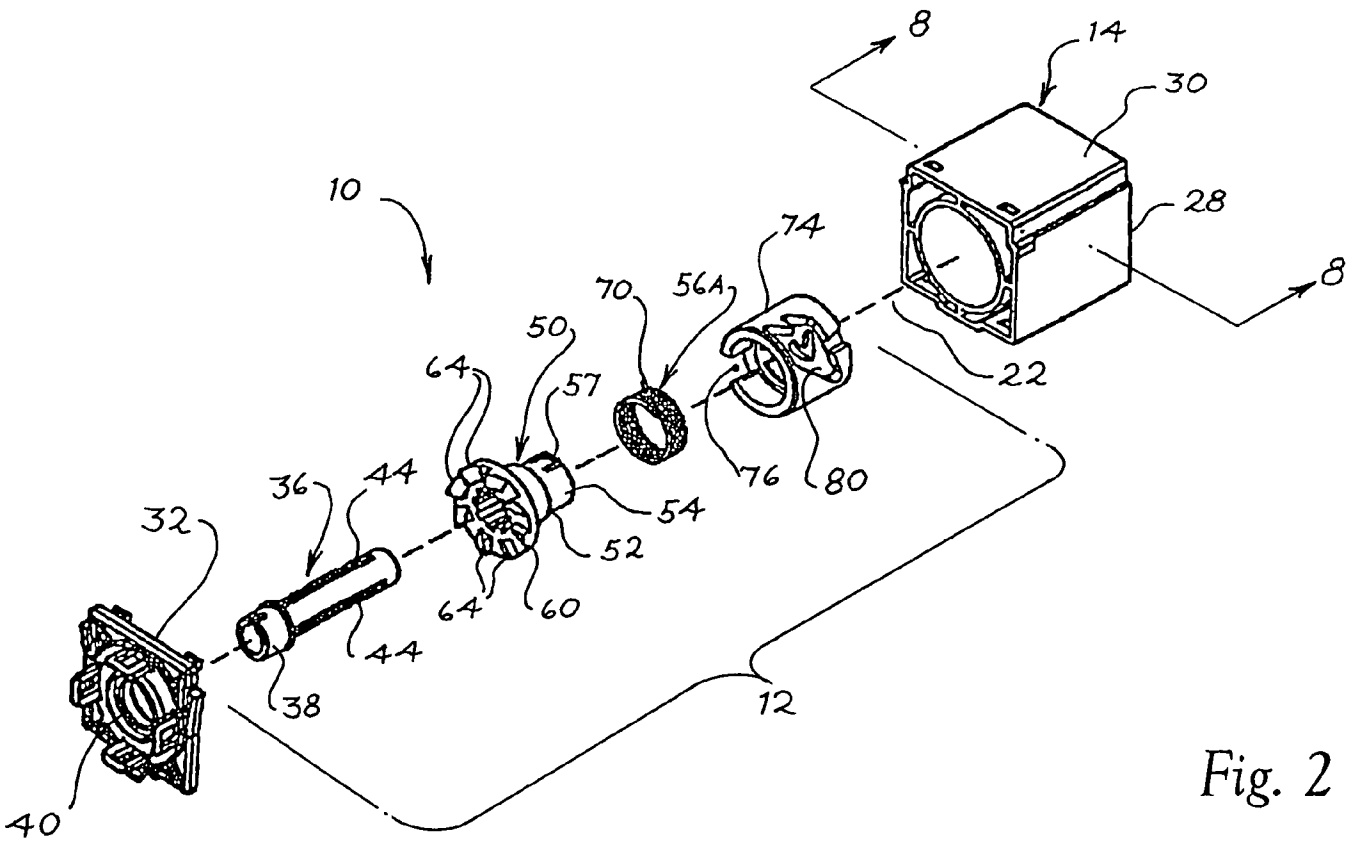
FIG. 2 is an exploded perspective view of the control module of FIG. 1.

Referring to FIGS. 1 and 2, housing 14 includes a hollow body 28 having a top wall 30, and a sidewall 32. Preferably, housing 14 is made of molded plastic or other suitable material whereas drive axle 20 is preferably made of a metal material to resist deformation, although other materials such as plastic composites could be used as well.

Figure 6:
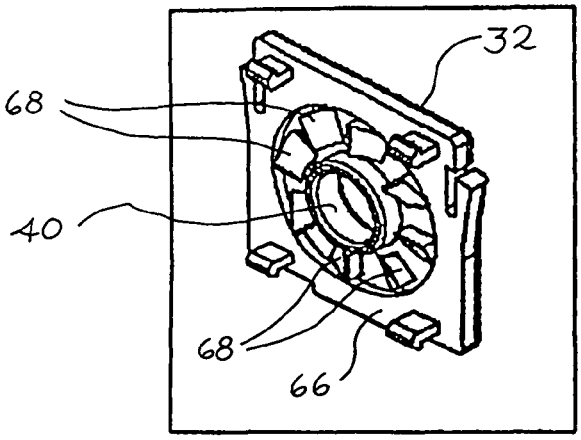
FIG. 6 is an inside perspective view of the housing end plate.

Turning now to FIG. 2, the various components of the control mechanism 10 are shown. Housing 14 is preferably sized to fit within the channel of a head rail (not shown). Sidewall 32 forms a wall of the housing. Referring now to FIG. 6, sidewall 32 has an inner surface 66 that faces the interior of the housing 14. The inner surface 66 includes first gripping structure, which in this preferred embodiment comprises a circular array of protruding cogs 68 disposed around the central opening 40. As will be detailed later, when coupling element 50 slides along drive axis 22 toward the inner surface 66 of the sidewall 32, a second gripping surface, such as cogs 64, of coupling element 50 can engage with cogs 68 of the sidewall 32 for blocking rotation of drive shaft 20

Referring again to FIGS. 1 and 2, disposed within housing 14 is the clutch module 12 (FIG. 1), which include an adapter sleeve 36, a coupler element 50, a locking arrangement, such as coil spring 56A, and a reciprocator 74. The interior of adapter sleeve 36 is configured to snugly fit about the drive axle 20 (FIG. 5), which is typically of a square or rectangular cross-section. The interior of adapter sleeve 36 is configured so as to prevent relative rotational movement between the drive axle 20 and the sleeve 36. Formed on the exterior of the adapter sleeve is a plurality of radial ribs 44 to provide keyed engagement for mounting a coupling element 50. Because the sleeve 36 is snugly mounted to drive axle 20, it will rotate together with the drive axle 20. Sleeve 36 includes a free end 38 that can be freely passed through a central opening 40 of end plate 32. While the sleeve 36 and drive axle are preferably independently formed, it is contemplated that the adapter sleeve could be integral or unitary with the drive axle.

Coupling element 50 includes a cylindrical body portion 52 about which the locking arrangement 56, such as coil spring 56A, is tightly mounted. Coupling element 50 further includes a plate 60 having a generally disc-like shape and connected with an end of the body portion 52. A central bore is formed through the coupling element 50 with longitudinal recesses for receiving radial ribs 44 of sleeve 36 when sleeve 36 is assembled through the coupling element 50. Thus, coupling element 50 is rotationally locked with sleeve 36 (and hence drive shaft 20) around drive axis 22, but is free to slide axially along the length of sleeve 36. Plate 60 preferably has an outer diameter greater than that of body 52 for providing axial confinement for coil spring 56A and reciprocator element 74. A plurality of cogs 64 protrude outwardly from an outer surface of plate 60 and project toward an inner surface 66 of sidewall 32 that is visible in FIG. 6.

As discussed, the locking arrangement can include a coil spring 56A configured to fit about the cylindrical body portion 52 of the coupling element 50. In a neutral state, the coil spring 56A is configured to lock with body portion 52. Coil spring 56A further includes a pair of out-turned lugs 70 which, when pushed toward each other, operate to expand the coils of the coil spring 56A to relax engagement of the coil spring 56A around body portion 52 of coupling element 50. The locking arrangement may take other forms, such as a sleeve frictionally engaged with the coupling element. Alternatively, the reciprocator may be configured to fit about the coupling element in frictional engagement therewith. In these embodiments, sufficient force will overcome the static friction and allow relative rotational movement.

Figure 3:
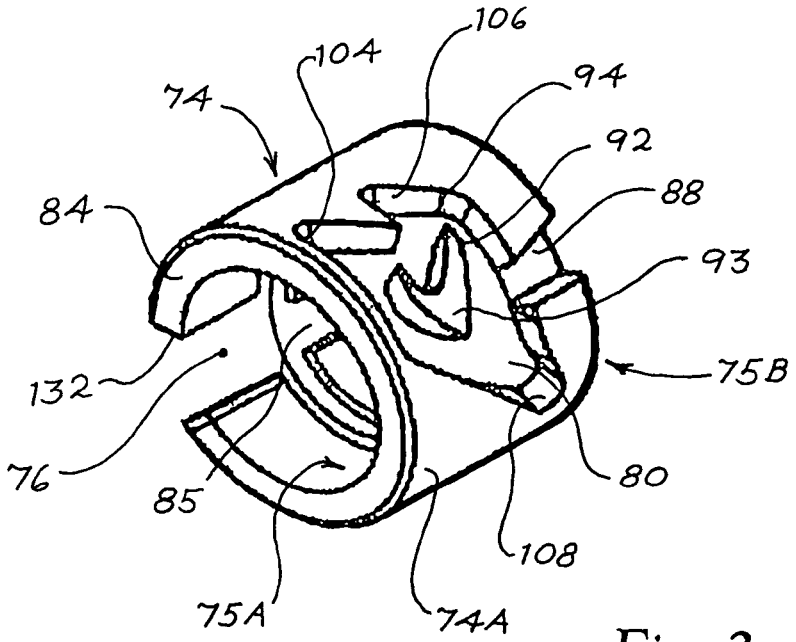
FIG. 3 is a perspective view of the reciprocator element thereof, taken on an enlarged scale.
Figure 9:
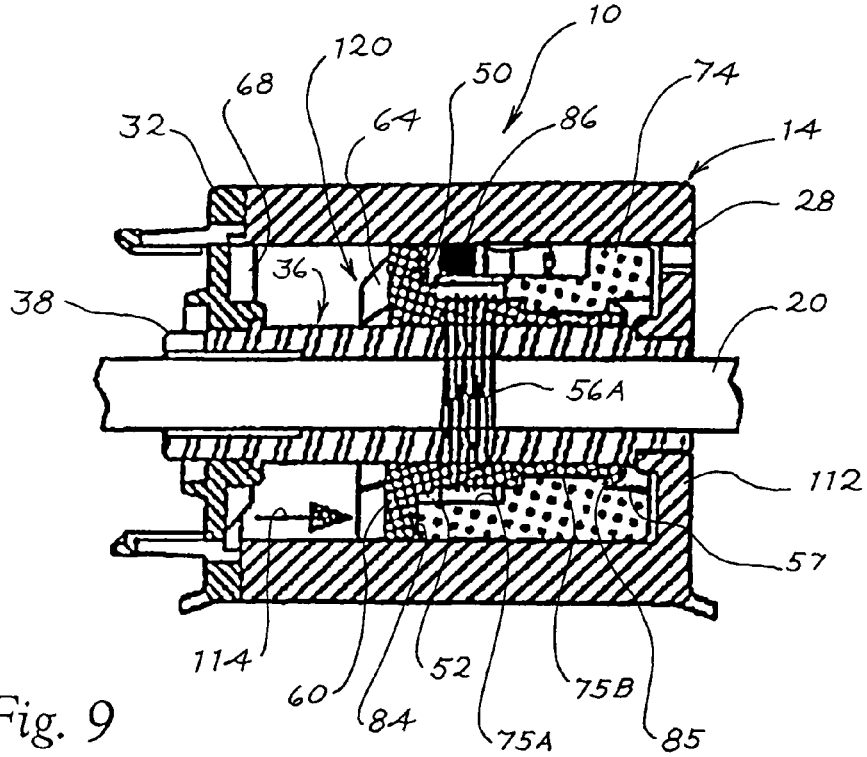
FIG. 9 is cross-sectional view taken along the line 9-9 of FIG. 1.

Referring again to the preferred embodiment, when assembled, reciprocator element 74 is mounted about coil spring 56A. As shown in FIGS. 3 and 9, reciprocator element 74 can be in the form of a generally cylindrical part that includes an outer surface 74A and two coaxial shaft hole sections of different diameters communicating with each other. More specifically, a first shaft hole section 75A has a first diameter greater than the diameter of the first body portion 52 of coupling element 50 plus the thickness of the coil spring 56A, whereas a second shaft hole section 75B has a smaller second diameter that is approximately equal or slightly greater than second body portion 54 of coupling element 50. A sidewall of the first shaft hole section 75A includes a radial slot 76 that has a width greater than the distance between the two lugs 70 of the coil spring 56A. When the coupling element 50 is assembled through the reciprocator element 74, a first edge 84 of the reciprocator element 74 lies adjacent to the plate 60, the second body portion 54 of the coupling element 50 is supported through the second shaft hole section 75B, and the first body portion 52 of the coupling element 50 with the coil spring 56A tightly assembled thereon lies in the first shaft hole section 75A. Radial flanges 57 can abut against a second edge 85 of the reciprocator element 74 opposite the first edge 84 to axially lock the reciprocator element 74 relative to the coupling element 50. Once the coupling element 50 with the coil spring 56A thereon is assembled with the reciprocator element 74, the two lugs 70 of the coil spring 56A are positioned in the radial slot 76.

Figure 10:
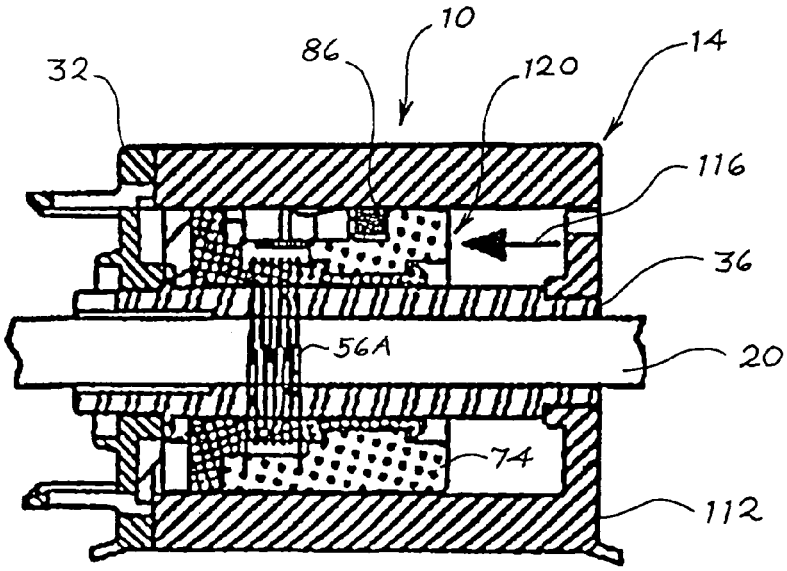
FIG. 10 is a cross-sectional view similar to that of FIG. 9 but showing the control module in a different operating configuration.

Referring to FIGS. 9 and 10, the assembled structure and relative positions of the aforementioned parts may be more easily understood. FIGS. 9 and 10 show a cross-sectional view of control mechanism 10 in two different stages of operation. As can be seen in FIGS. 9 and 10, housing 14 is comprised of hollow body 28, sidewall 32 and a sidewall portion 112 of hollow body 28. Sleeve 36 extends between sidewall 32 and sidewall 112 and is journaled for rotation as drive shaft 20 is rotated in opposite directions. In effect, sleeve 36 forms an axial track within housing 14 about which components may slide or reciprocate back and forth in directions parallel to the axis of drive shaft 20. The parts that reciprocate back and forth within housing 14 form a coupling block assembly 120 comprised of coupling element 50, coil spring 56A and reciprocator element 74. As indicated by arrow 114 in FIG. 9, the coupling block assembly 120 is moved to the right hand direction, toward sidewall 112. In the position illustrated in FIG. 9, cogs 64 of coupling element 50 are spaced, i.e. disengaged or decoupled from cogs 68 of sidewall 32. As shown in FIG. 10, the coupling block assembly 120 has been moved to the left as indicated by arrow 116, to bring the cogs 64, 68 of the coupling element 50 and sidewall 32 into engagement with one another, thus blocking the coupling element 50, sleeve 36 and drive shaft 20 from rotation in either direction.

With the above construction, rotation of the coupling element 50 driven by the drive axle 20 can be transmitted to the reciprocator element 74 via either of the two lugs 70 of the coil spring 56A contacting with a corresponding sidewall of the radial slot 76. Moreover, the reciprocator element 74 and coupling element 50 can slide synchronously as a unitary member block relative to the sleeve 36 along the drive axis 22, either toward or away from the sidewall 32. Rotation of the coupling element 50 and reciprocator element 74 can also be converted into a sliding movement thereof through the interaction between a guide track 80 provided on the outer surface 74A of the reciprocator element 74 and a fixed key or protrusion 86 projecting inward from top wall 30 of housing 14.

Figure 7:
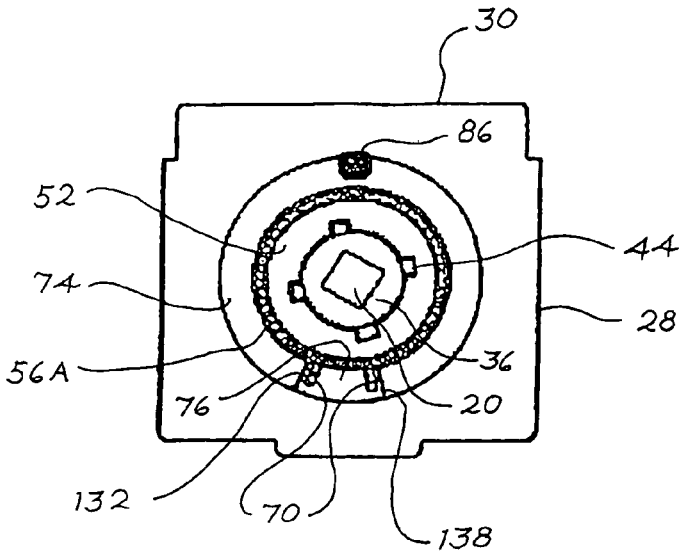
FIG. 7 is a fragmentary cross-sectional view taken along the line 7-7 of FIG. 5.
Figure 8:
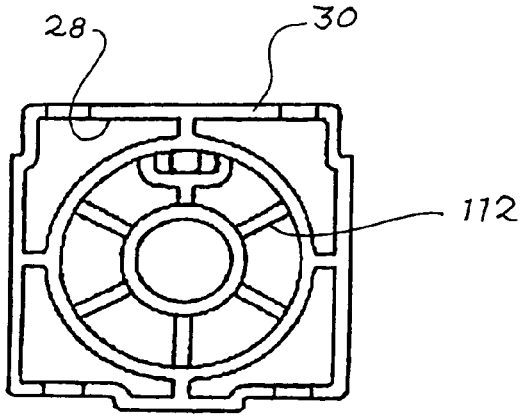
FIG. 8 is a cross-sectional view taken along the line 8-8 of FIG. 2.

As shown in FIGS. 5 and 7, the protrusion or key 86 fixedly projects inward from a top wall 30 of housing 14 toward the interior of the housing 14, preferably along a radial direction relative to the rotation axis 22. The key 86 can extend within the guide track 80 of the reciprocator element 74.

Figure 4:
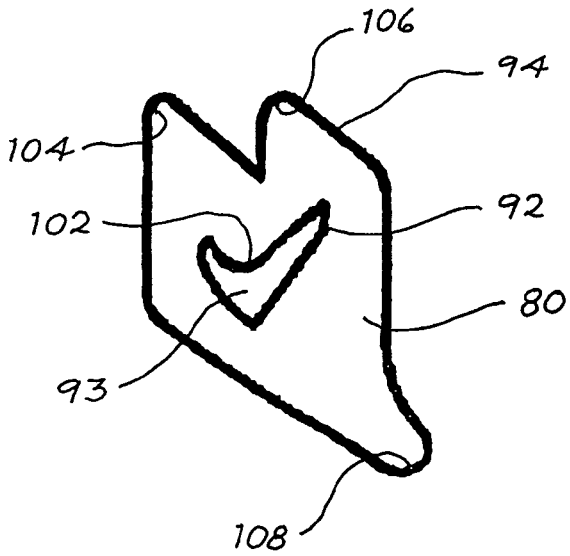
FIG. 4 is a top plan view of a guide track of the reciprocator element.
Figure 5:
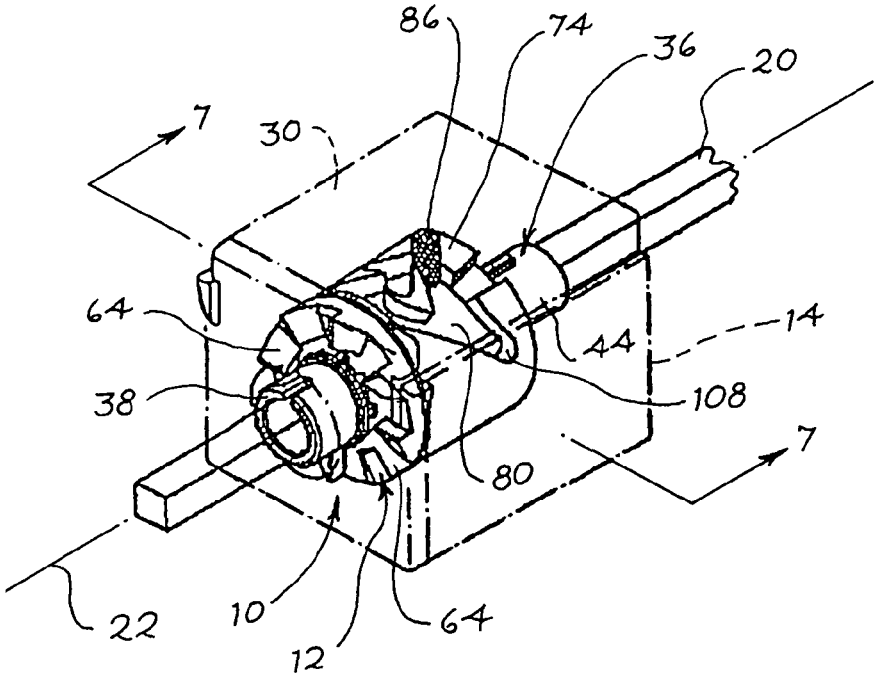
FIG. 5 is a fragmentary perspective view of the control module with the housing shown in phantom.

As shown in FIGS. 3 and 4, the guide track 80 is formed on the outer surface 74A of the reciprocator element 74. In one embodiment, the guide track 80 may be a recessed surface formed with the reciprocator element 74 by plastic molding. In alternate embodiments, the guide track 80 may also be machined on the outer surface 74A of the reciprocator element 74. As shown, the guide track 80 is formed as a closed loop delimited between an inner sidewall 92 and outer sidewall 94. The outer sidewall 94 forms an outer contour of the guide track 80 having a foot-like or heart-like elongated shape. The inner sidewall 92 defines the contour of a protruding stud 93 surrounded by the outer sidewall 94. The guide track 80 is oriented in a direction that is transversal to the rotation axis 22, the inner and outer sidewalls 92 and 94 having a profile adapted to guide reciprocating movements of the reciprocator element 74 parallel with the rotation axis 22 and along the adapter sleeve 36.

In addition, the guide track 80 also includes a plurality of turn regions 102, 104, 106 and 108 that can be reached by the key 86 for stopping the reciprocator element 74 at different positions relative to the drive axle 20. Each of the turn regions 102, 104, 106 and 108 can be respectively defined by a pocket or concavity in the inner and outer sidewalls 92, 94. Referring to the embodiment illustrated in FIG. 5, the turn region 102 can be formed in the stud 93 to define a first end point of a displacement of the reciprocator element 74 in a first or anti-clockwise direction relative to the rotation axis 22. After the turn region 102, the turn region 104 in the upper left hand portion of guide track 80 defines a second end point of a displacement of the reciprocator element 74 in a second or clockwise direction relative to the rotation axis 22. The turn region 108 is formed in the outer sidewall 94 at a lower right hand portion of guide track 80 to define a third end point of a displacement of the reciprocator element 74 in the first direction relative to the rotation axis 22. In turn, the turn region 106 in a upper central portion of the guide track 80 is formed to define a fourth end point of a displacement of the reciprocator element 74 in the clockwise direction relative to the rotation axis 22.

Rotation of the reciprocator element 74 causes a sliding movement of the reciprocator element 74 relative to the rotation axis 22 owing to interaction between the fixed key 86 and guide track 80. In other words, because the key 86 is fixed in the housing, the guide track 80 will cause the reciprocator to slide axially as it is rotated. This movement of the reciprocator element 74 relative to the key 86 is stopped when the key 86 reaches one of the turn regions 102, 104, 106 and 108, which respectively correspond to different states of the clutch module 12. To switch from one state to another (i.e., from one turn region to a next turn region), reverse rotation of the drive axle 20 is required. A detailed explanation of the sequential movement of the reciprocator 74 will be set forth hereafter. As shown in FIG. 3, a passage 88 communicating with the guide track 80 can also be formed in the outer surface 74A of the reciprocator element 74 to facilitate the placement of the key 86 in the guide track 80 when the reciprocator element 74 is put in place in the housing 14.

Referring now to FIGS. 11-15, operation of the control module will be described with reference to a shade element. It should be understood, that the control module could be readily employed with many types of shade elements and is not limited to any particular shade element. In each of the FIGS. 11-15, the suffix "A" indicates a top plan view of the control module, while the suffix "B" shows the corresponding guide track in full, for descriptive purposes. Often times, the corresponding guide track is shown in a rotated position from that of the top plan view.

Figure 11A:
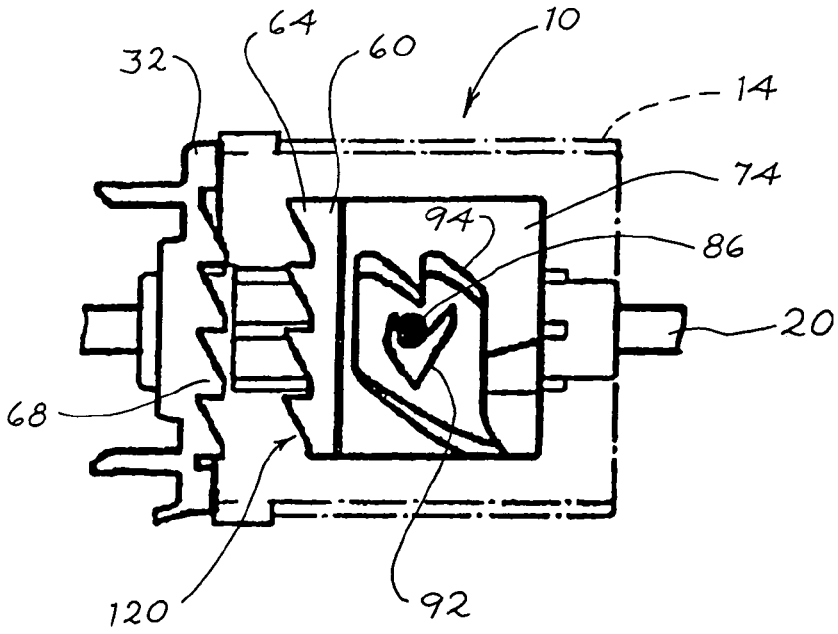
Figure 11B:
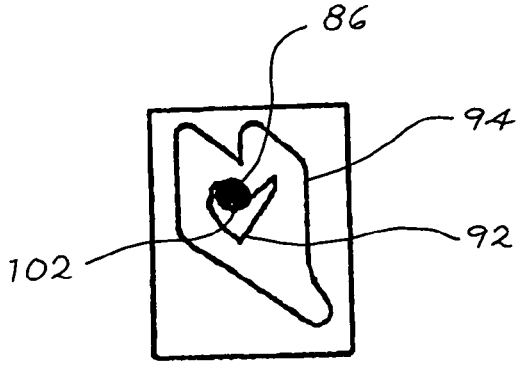

Operation of the control mechanism is explained with reference to FIGS. 11A through 15B. Referring to FIGS. 11A and 11B, the spring drive unit (not shown) exerts a rotational force on drive axle 20 such that stud 93 abuts key 86 in the turn region 102 of guide track 80 so as to stop the reciprocator 74. Such a condition corresponds to a lift-enabled state of the clutch module 12. Rotation of the drive axle 20 owing to the torque exerted by the spring of the drive unit causes a small amount of rotation of the coupling element 50 relative to the reciprocator 74, which causes one of the lugs 70 of the coil spring 56A to abut sidewall 138 of the radial slot 76. Through reaction force exerted by the stopped reciprocator 74 on the lug 70, the coil spring 56A is loosened, thereby allowing for rotation of the coupling element 50 and drive axle 20 relative to the reciprocator 74. The drive axle 20 thus can thereby continue to rotate and further wind the cord around the cord winding unit (not shown). Unless a user stops the raising of the bottom rail (as described below), this rotation will continue to lift the bottom rail until all of the shade element is stacked upward against the head rail.

Figure 12A:
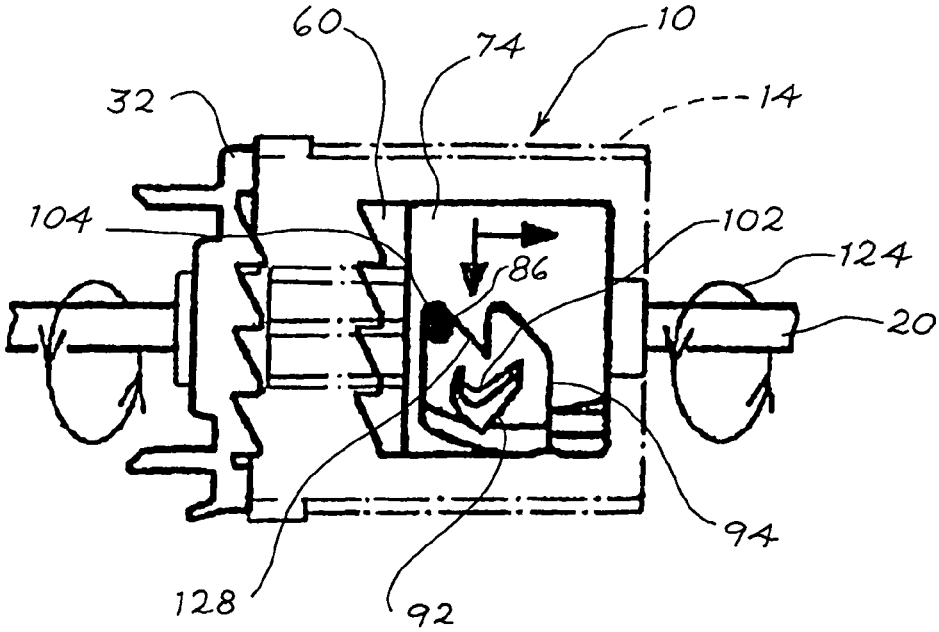
Figure 12B:
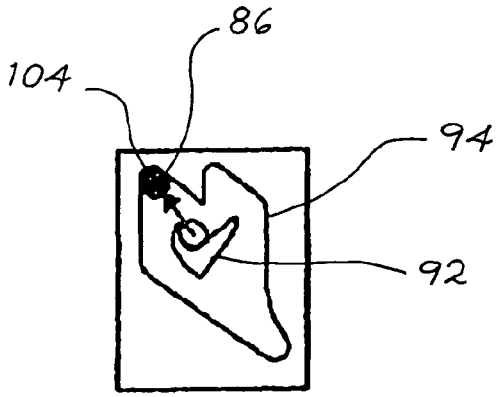

Referring to FIGS. 12A and 12B: rotation of the drive axle 20 (e.g., by the user pulling downward the bottom rail) in the anti-clockwise or second direction counteracts the force exerted by the spring drive that pressed the lug 70 on the sidewall of the radial slot 76 (FIG. 7). Therefore, the coil spring 56A re-engages the coupling element 50 such that rotation of the drive axle 20 is transmitted to the reciprocator 74. Owing to the interaction between the key 86 and guide track 80, the reciprocator 74 is caused to move away from the sidewall 32 of the housing 14 until the key 86 is received in the turn region 104 in the upper left portion of the guide track 80 to stop the reciprocator 74. In this position, the clutch module 12 is switched from the lift-enabled state to a lowering-enabled state. If the drive axle 20 is further rotated in the same direction, lug 70 of the coil spring 56A is pressed against the sidewall 132 of the radial slot 76 (FIG. 7), such that coil spring 56A is loosened to permit rotation of the drive axle 20 and coupling element 50 relative to the blocked reciprocator 74 for lowering the bottom rail.

Figure 13A:
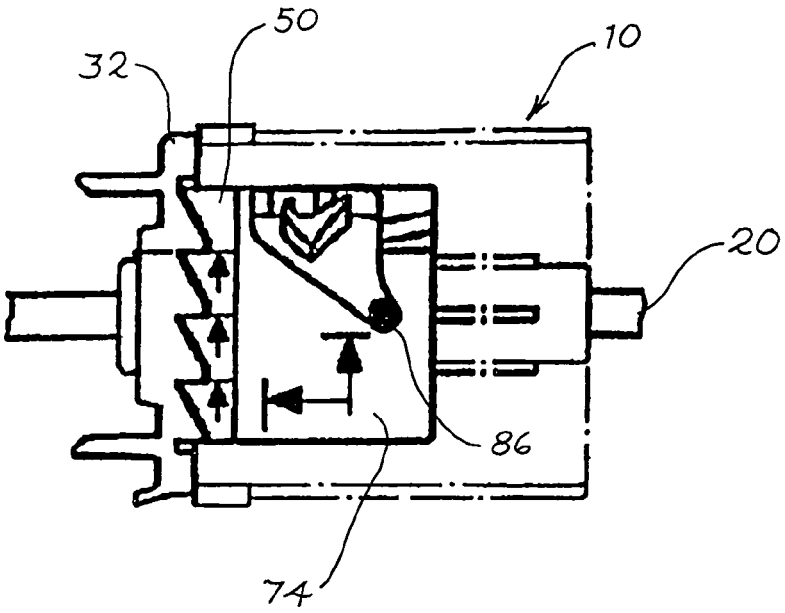
Figure 13B:
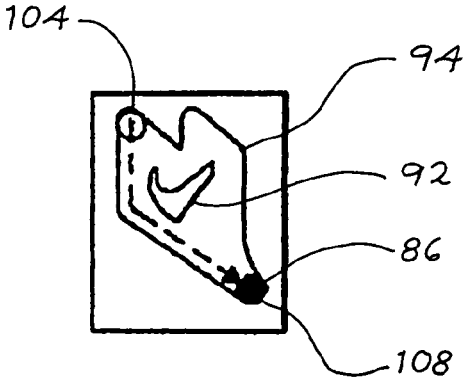

Referring to FIGS. 13A and 13B: while the clutch is in the lowering-enabled state, if the user removes the lowering force, the rotational force exerted by the spring drive unit on the drive axle 20 causes a slight movement in the first direction such that the coil spring 56A tightly grips again on the coupling element 50, and the torque applied by the spring drive unit causes the drive axle 20 and coupling element 50 to rotate in a clockwise or first direction, which is transmitted via the coil spring 56A to the reciprocator 74. Owing to the interaction between the key 86 and guide track 80, the reciprocator 74 moves relative to the key 86 until the key 86 is positioned in the turn region 108, which as shown is the lower right hand portion of the guide track 80. Due to the interaction of the key 86 and the guide track 80, the reciprocator 74 is caused to move axially toward the sidewall 32 of the housing 14 until the cogs 64 provided on plate 60 of the coupling element 50 engage cogs 68 provided on the sidewall 32 of the housing 14 (see FIGS. 5 and 6). The engagement of cogs 64 and 68 approximately corresponds to the placement of the key 86 in the turn region 108. The clutch module 12 is thereby switched to a lift-locked state, in which rotation of the drive axle induced by the spring torque is effectively blocked.

Figure 14A:
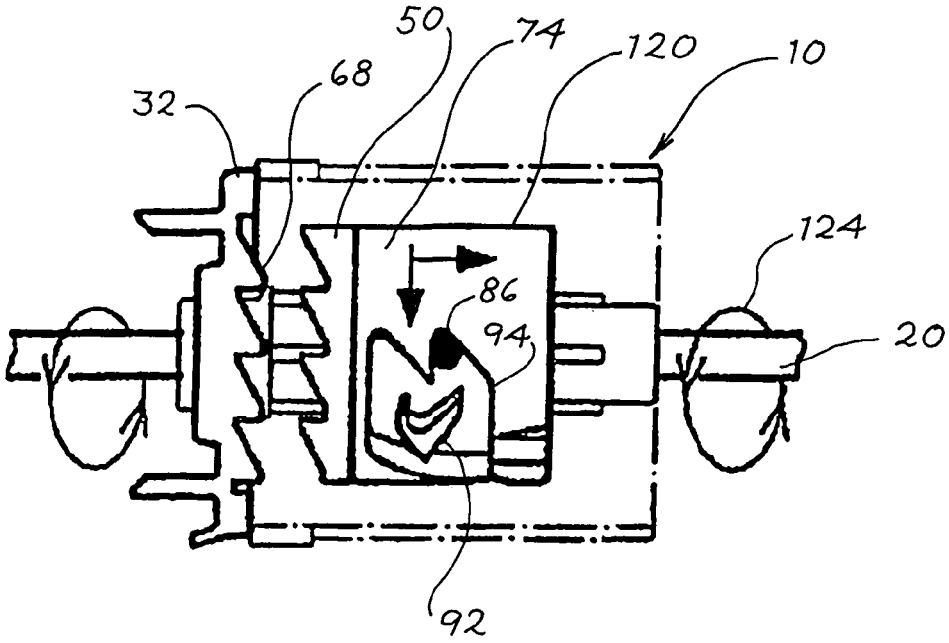
Figure 14B:
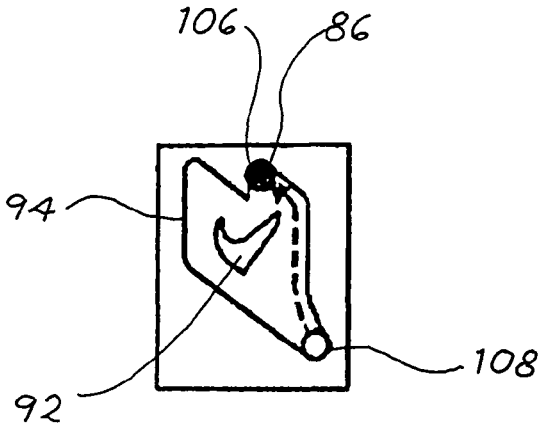

Referring to FIGS. 14A and 14B, if the user pulls down the bottom rail, the resulting rotation of the drive axle 20 and coupling element 50 is transmitted via the coil spring 56A to the reciprocator 74. Owing to the interaction between the key 86 and guide track 80, the reciprocator 74 is caused to move axially away from the sidewall 32 of the housing 14 until the key 86 is located in the turn region 106 in an upper central portion facing at least one concave portion of the stud 93, whereby the lift-locked state is effectively removed because cogs 64 are disengaged from cogs 68.

Figure 15A:
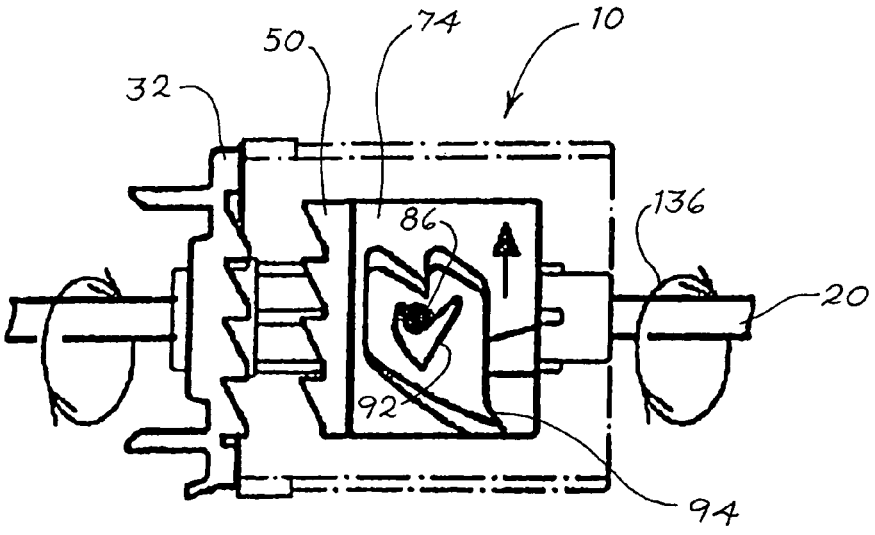
Figure 15B:
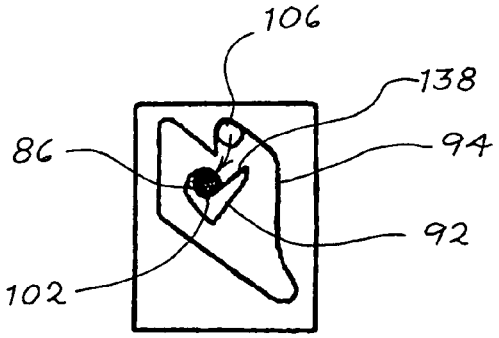

Referring to FIGS. 15A and 15B, after the lift-locked state is removed, the user can release the bottom rail, such that the spring drive unit causes the drive axle 20, coupling element 50 and reciprocator 74 to rotate in the first or clockwise direction until the key 86 is positioned in the turn region 102 again, thereby allowing the shade element to be raised.

Referring now to FIGS. 16-20, a second embodiment of a control mechanism generally indicated at 212, will be described. Several features of control mechanism 212 are similar to those of control mechanism 12, described above and accordingly common reference numerals will be used to describe those common features. Control mechanism 212 differs in its configuration of reciprocator element 274. A second difference is that operating mechanism 212 relies upon different components to lock drive shaft 20 from rotating, other than the inter-engaging cogs employed in operating mechanism 12. Throughout FIGS. 16-20, the suffix "A" indicates a perspective view of the control mechanism 212 whereas the suffix "B" indicates a cross-sectional view corresponding to the same operating position.

Figure 16A:
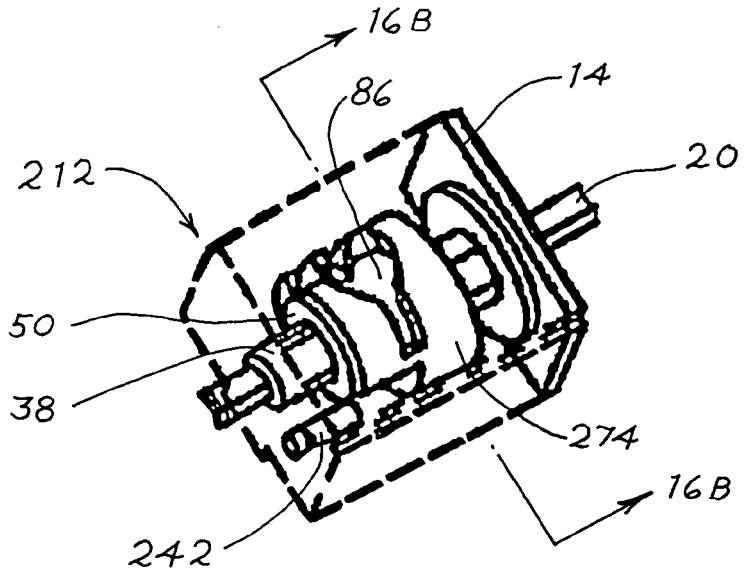
Figure 16B:
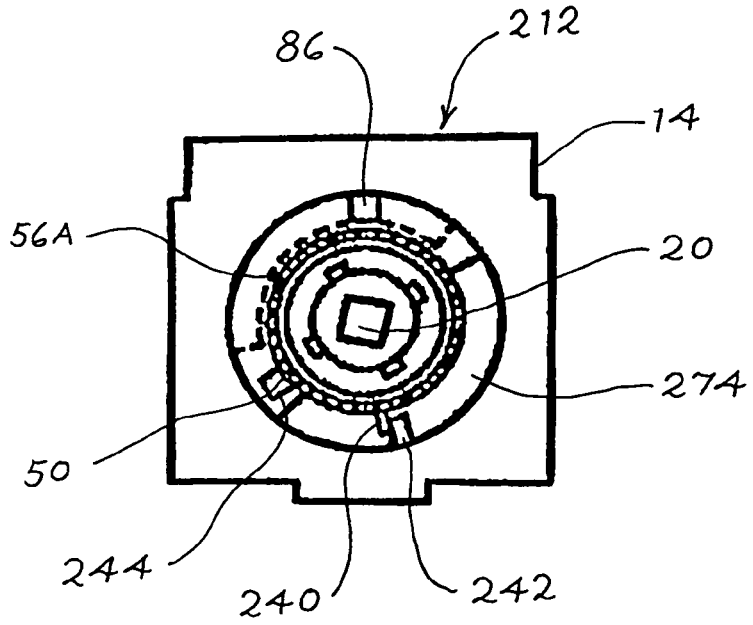

FIGS. 16A, 16B are taken with the control mechanism corresponding to a fully retracted shade element. Spring 56A is in a relaxed condition with a lug 240 with a protrusion 242 formed in the interior of housing 14. Spring 56A thereby tightens on coupling element 50 with drive force being transmitted to reciprocator element 274.

Figure 17A:
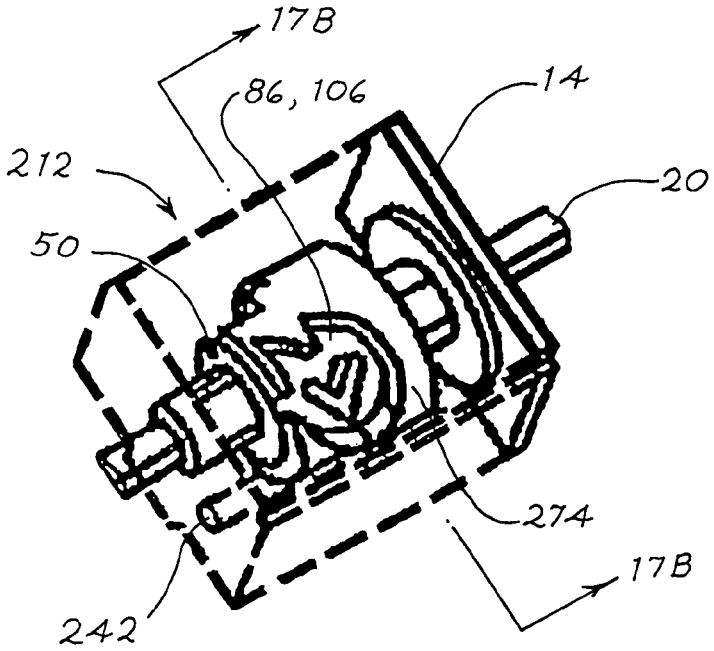
Figure 17B:
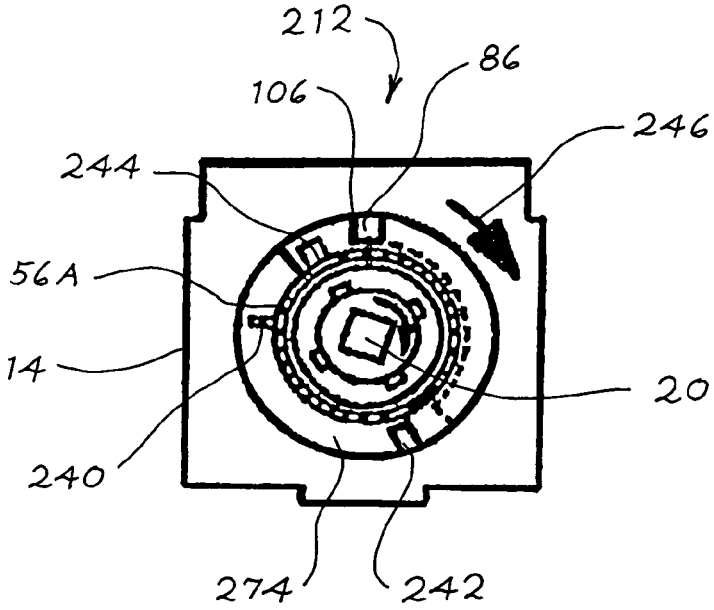

Referring to FIGS. 17A, 17B, as the reciprocator element 274 abuts key element 86, coil spring 56A relaxes, disconnecting the lock between coupling element 50 and reciprocator element 274, allowing the user to freely extend the shade element a desired amount.

Figure 18A:
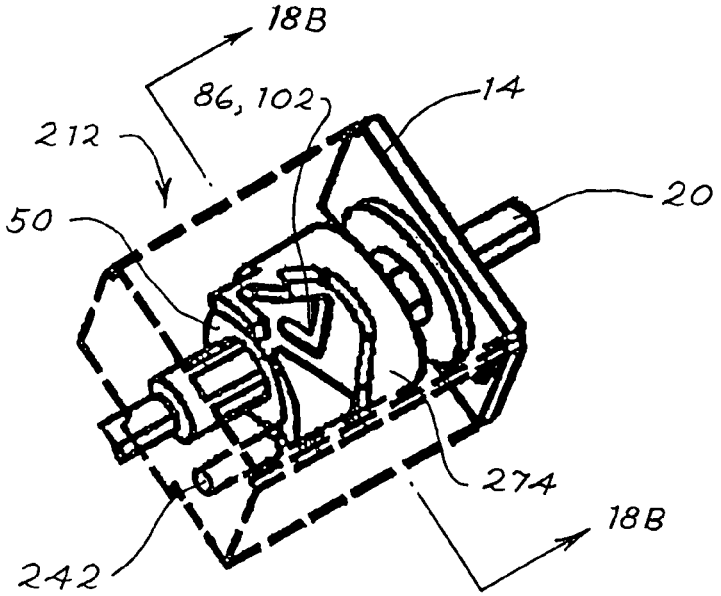
Figure 18B:
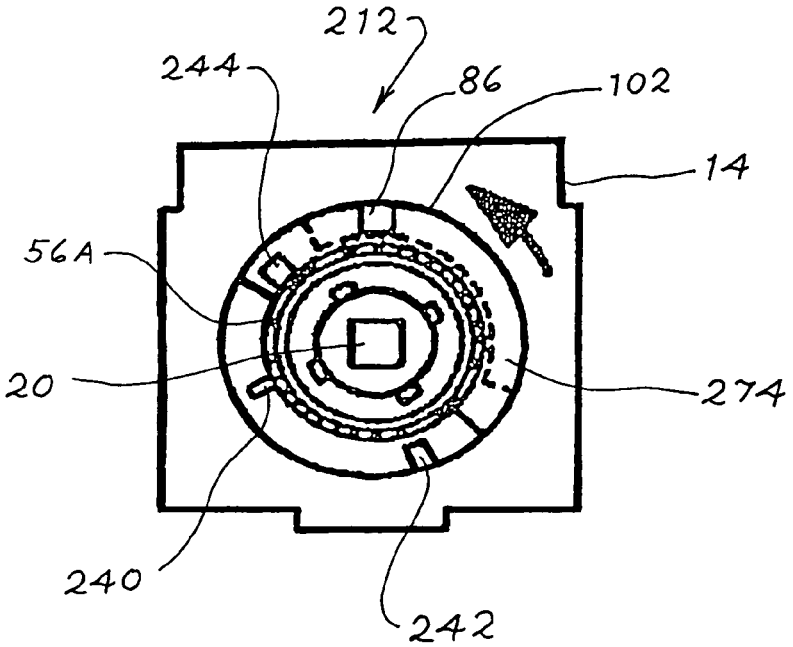

Referring now to FIGS. 18A, 18B, operating mechanism 212 is shown at a point in time when a user releases pulling force on the shade element, allowing the shade element to assume a fully or partly extended position. As the user releases the shade element at a desired height, coil spring 56A tightens on coupling element 50 and the drive axle 20 is urged by the drive unit (not shown) to rotate reciprocator element 274 in a counterclockwise direction (with frame of reference taken from the left hand end of FIG. 18A) until the reciprocator element 274 reaches the locking position as shown, with key 86 engaging turn region 102 of reciprocator element 274. In this locking position, the coil spring 56A tightens to stop rotation of drive axle 20 against force exerted on the drive shaft by the drive unit (not shown).

Figure 19A:
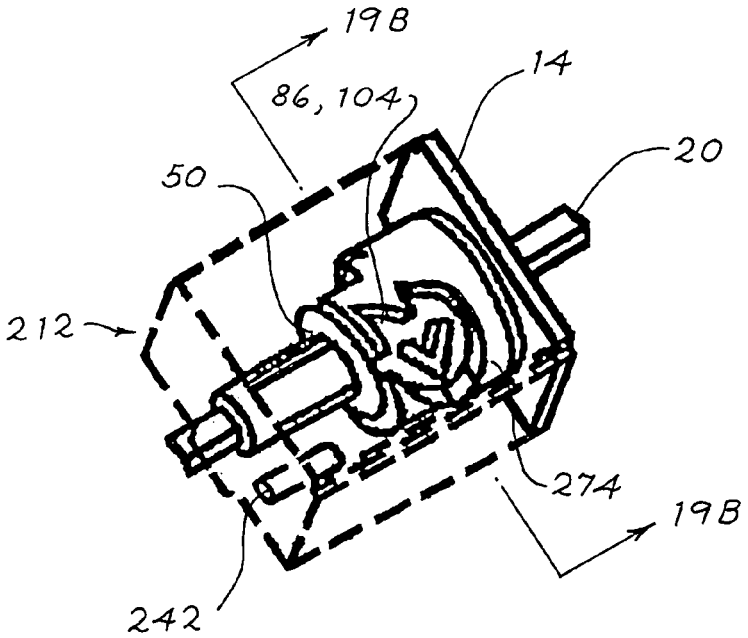
Figure 19B:
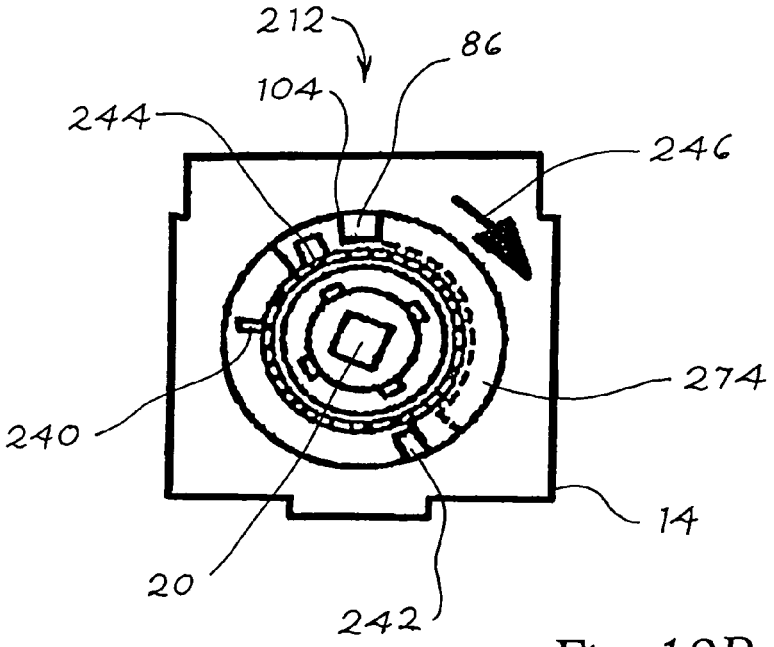

Turning now to FIGS. 19A, 19B, as the user applies an extending force to the shade element, coil spring 56A tightens in a resulting clockwise rotation of drive axle 20 and coupling element 50 causes the reciprocator element 274 to disengage from the locking position at turn region 102 to a release position at turn region 104.

Figure 20A:
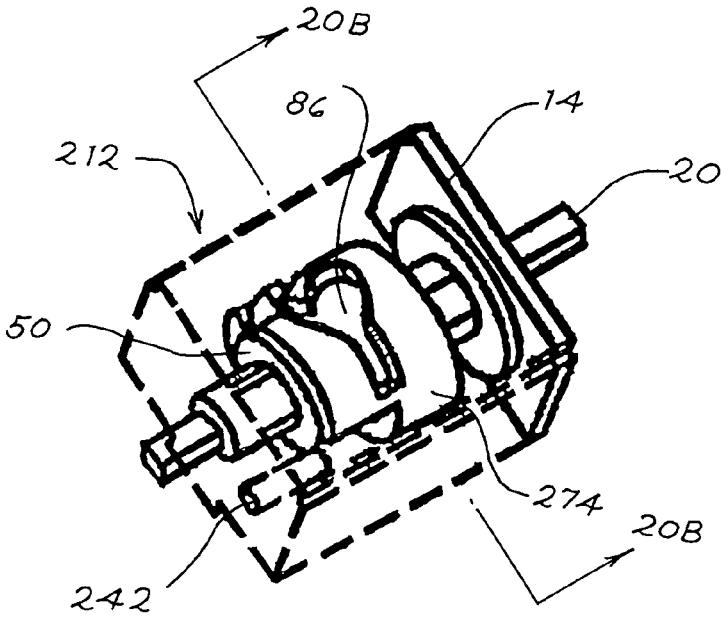
Figure 20B:
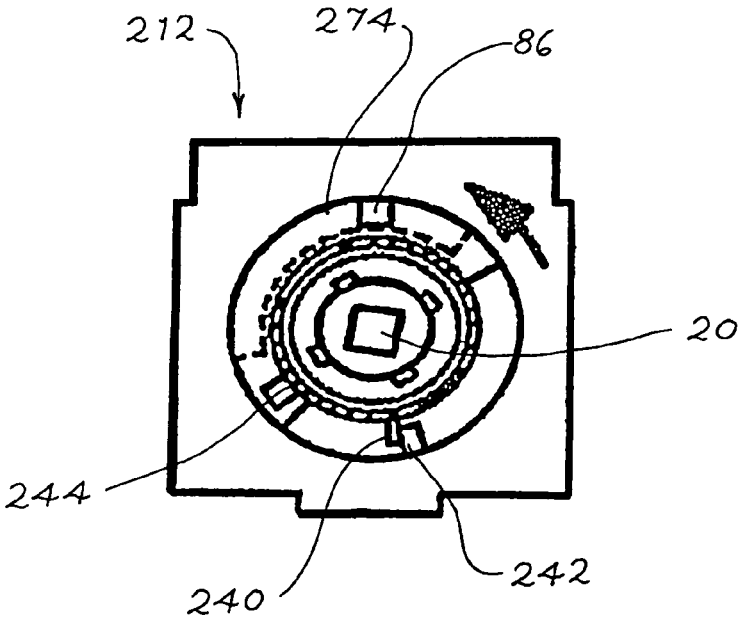
Figure 21:
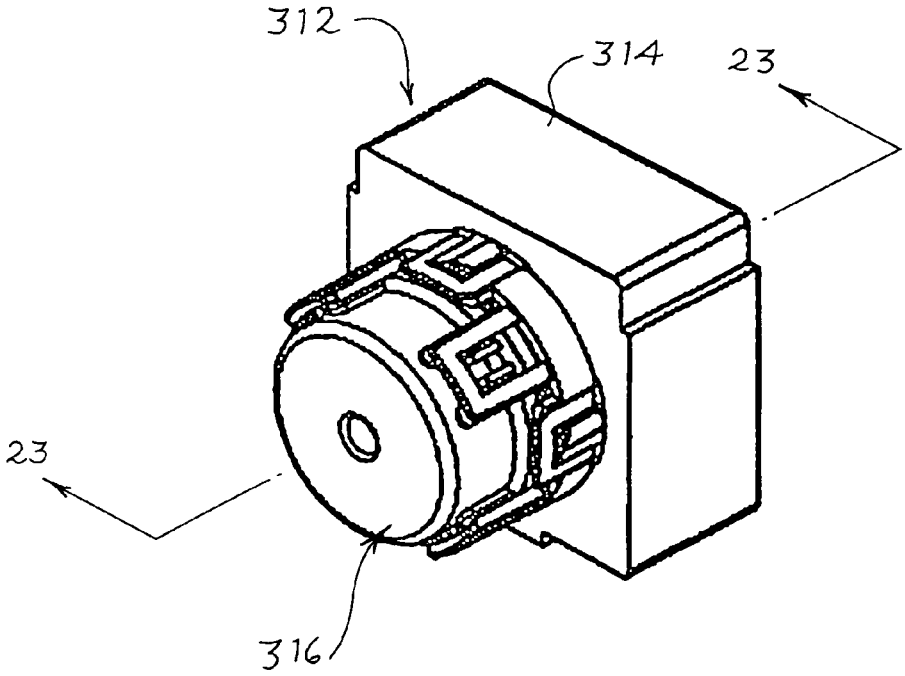
FIG. 21 is a perspective view of a cushioning control device according to the present invention.

Referring now to FIGS. 20A, 20B, the spring drive unit (not shown) causes drive axle 20 to rotate in the counterclockwise direction (with reference to the left hand end of FIG. 20A) to bring lug 240 of spring 56A into engagement with housing protrusion 242, thereby loosening spring 56A, unlocking drive axle 20, permitting the drive axle to continue to rotate and move the shade element to a fully retracted position.

Figure 22:
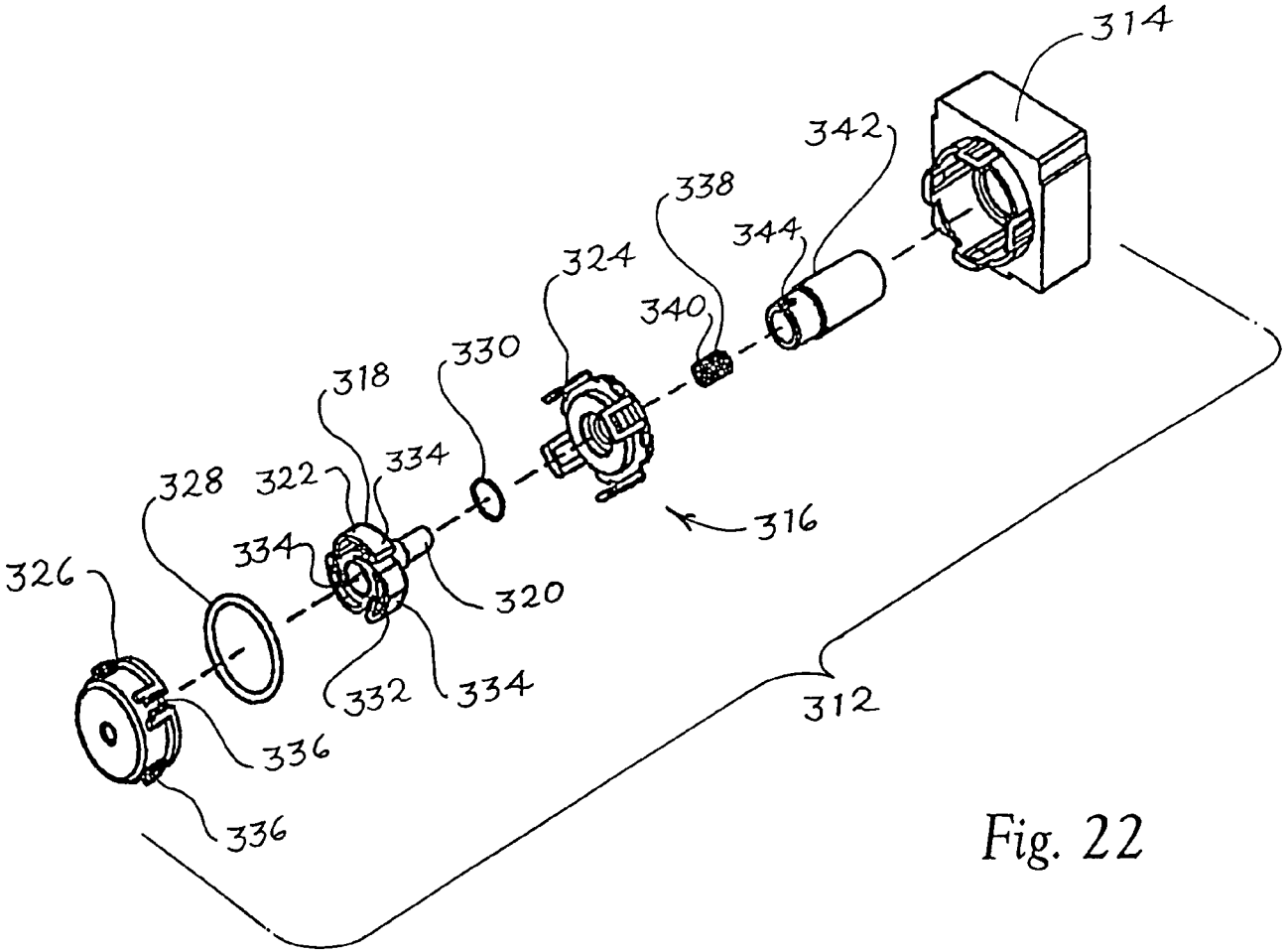
FIG. 22 is an exploded perspective view thereof.
Figure 23:
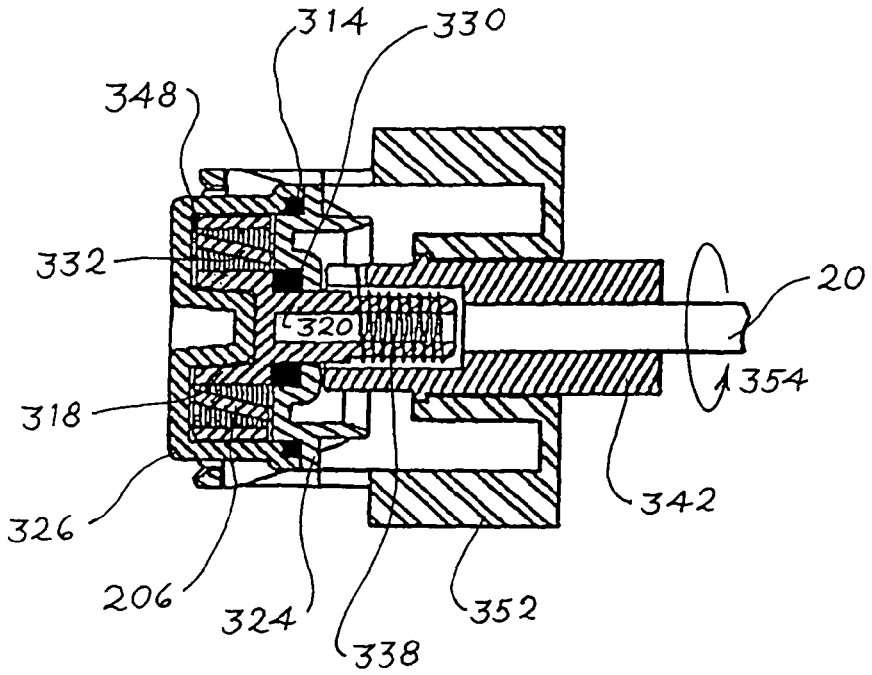
FIG. 23 is a cross-sectional view taken along the line 23-23 of FIG. 21.

Referring now to FIGS. 21-24, a control mechanism in the form of a cushioning module is generally indicated at 312. Included is a housing 314 and a cushioning mechanism generally indicated at 316. With reference to FIGS. 22 and 23, a rotor 318 includes a hub or shaft portion 320 and blade portions 322. A lid 324 and a casing 326 are provided to complete the housing 314. Blades 322 are lodged in a hollow cavity 348 between rib 324 and casing 326, and is sealed by sealing rings 328, 330. The hollow cavity is filled with a cushion medium such as a viscous fluid, gel or a granular composition.

The blades 322 extend generally radial from the shaft portion 320. Preferably, the shaft portion 320 is indirectly connected to the drive shaft through intervening components. The cushion medium acts upon the blades 322 of rotor 318 to provide a one-way or unidirectional cushioning that cushions rotation of drive shaft 320.

Lid 324 and casing 326 are held together in secure engagement by fastener claws 324A provided on lid 324 which engage flanges 336 of casing 326. Also included in the cushioning device is a coil spring 338 with a protruding tip or lug 340. The spring 338 comprises a locking member between the hub and the drive shaft to selectively lock the shaft portion 320 in the first rotational direction for common movement with the drive shaft and to selectively unlock the shaft portion 320 in an opposite rotational direction for independent movement with the drive shaft. Assembly of cushioning device 316 is completed with a sleeve 342 that is rotationally fixed to the drive shaft and includes a slot 344 formed at one end, for receiving spring lug 340. Spring 338 is tightly fitted about drive shaft 320 of the rotor, with the lug 340 engaging sleeve 342.

Referring now to FIG. 23, the hollow cavity between rotor 318 and casing 326 is indicated by reference numeral 348. As mentioned, the hollow cavity is filled with a cushion medium such as viscous oil. Shaft portion 320 of the rotor 318 protrudes beyond lid 324 and receives spring 338. As indicated in FIG. 23, rotor 318 is coupled or selectively locked to an adjacent device such as drive shaft 20 of one of the aforementioned control mechanisms such as clutch module. In FIG. 23, the adjacent module is generally indicated by reference numeral 352. For example, when control module 10 is the adjacent component whose operation is complemented by the cushioning mechanism, numeral 352 of FIG. 23 will comprise the end plate 32 of control module 10. When assembled, shaft portion 320 and spring 338 are fitted within sleeve 342, with lug 340 of spring 338 fitted within the slot 344.

As mentioned, a drive unit (not shown in FIG. 23) such as a spring motor is employed to rotate drive shaft 20 in a direction so as to retract the shade element (assumed to be a counterclockwise direction taken from the right hand end of FIGS. 22 and 23). Sleeve 342, being rotationally fixed to drive shaft 20, rotates in the same direction as the drive shaft thus applying a force to lug 340 (e.g., toward the right side on FIG. 24), thereby tightening the coils of spring 338 so as to engage or lock shaft portion 320 with sleeve 342. Rotation of the drive shaft 20 can thereby drive rotation of rotor 318 and its blades 322.

As illustrated in FIG. 23, blades 322 are immersed in the cushion medium filling cavity 348, which cause resistance to the rotation of rotor 318 in the counterclockwise direction of arrow 354 of FIG. 23. Rotation of the drive shaft 20 in the counterclockwise direction can be therefore cushioned by the interaction between the blades 322 with the cushion medium. When drive shaft 20 is rotated in a direction opposite to that of arrow 354, the cushion medium in cavity 348 presents a lesser resistance when the rotor 318 rotates in one direction. As can be seen in FIG. 22, blades 322 extend radially outwardly from shaft portion 320 and then curve in a counterclockwise direction (taken from the point of reference of the right hand end of FIGS. 22 and 23, in the direction of arrow 354). Thus, when rotor 318 is rotated in the counterclockwise direction, its rotation is met with increased resistance whereas when the rotor is rotated in an opposite, i.e., counterclockwise direction, its rotation is met with a lesser resistance. Thus, it can be seen that the present invention provides a rotational dampening, deceleration or resistance which is unidirectional.

In addition to the advantageous configuration of blades 322 to reduce frictional resistance in one direction of rotation, the present invention provides further features to eliminate virtually all resistance in the opposite direction of rotation, that direction preferably incurred when the shade element is extended with rotation in a direction opposite to that of arrow 354 of FIG. 23. When drive axle 20 rotates in a direction to extend the shade element, sleeve 342 is again rotated along with the drive shaft 20 and operates to apply a force to lug 340 in a direction (e.g., toward the right side of FIG. 24) that expands the coils of spring 338, which accordingly loosens its grip on the shaft portion 320 and unlocks the rotational coupling between shaft portion 320 and sleeve 342. In this mode of operation, the rotor 318 remains stationary, decoupled from sleeve 342 so that sleeve 342 is free to rotate along with drive shaft 20 in the clockwise direction for lowering the shade element. Thus, cushioning action can be effectively disabled when the drive shaft 20 rotates in the clockwise direction for lowering the shade element.

Figure 24:
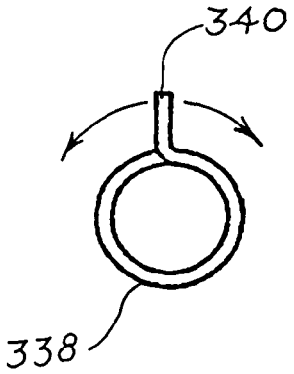
FIG. 24 is an end view of the spring element of FIG. 22.

Referring now to FIG. 24, spring 338 is shown with an enlarged scale from a point of reference at the right hand end of FIG. 23. As mentioned above, lug 340 is acted upon by slot 344 of sleeve 342. When the force on lug 340 operates in a leftward direction, the coils of spring 338 are tightened, locking its grip on rotor 318 and thereby locking rotor 318 for rotation with sleeve 342. When force is applied to lug 340 in the right hand direction, the coils of spring 338 are loosened, allowing shaft 320 of rotor 318 to rotate within the spring.

Figure 25:
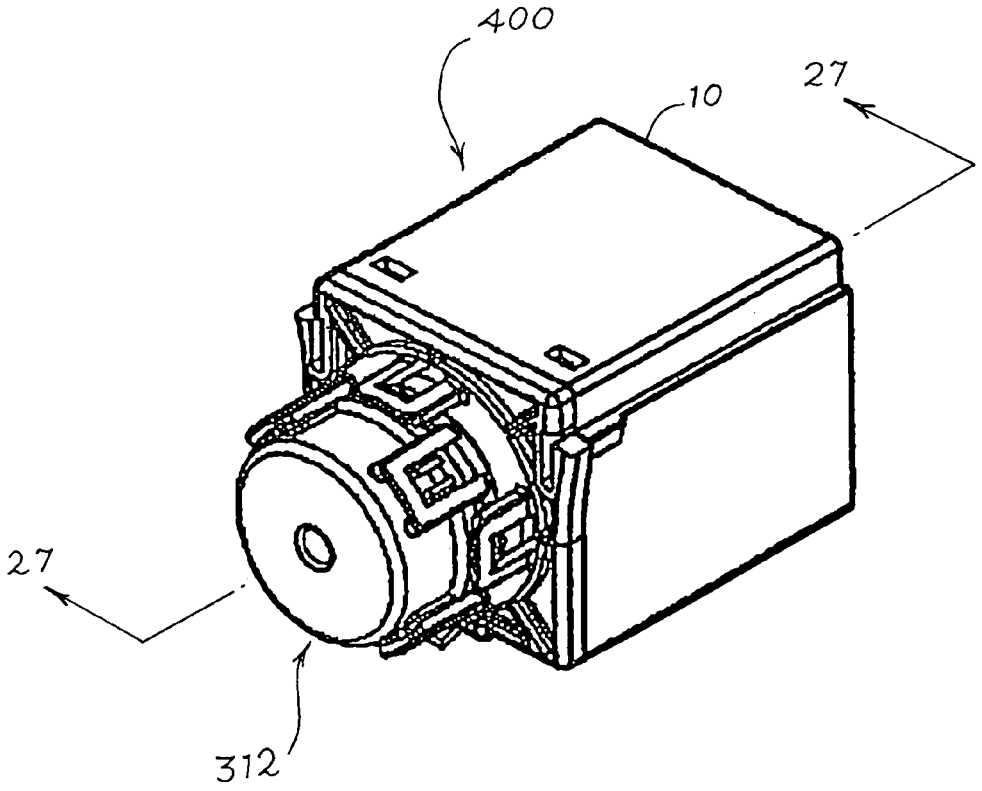
FIG. 25 is a perspective view of a multifunction control mechanism according to the present invention.
Figure 26:
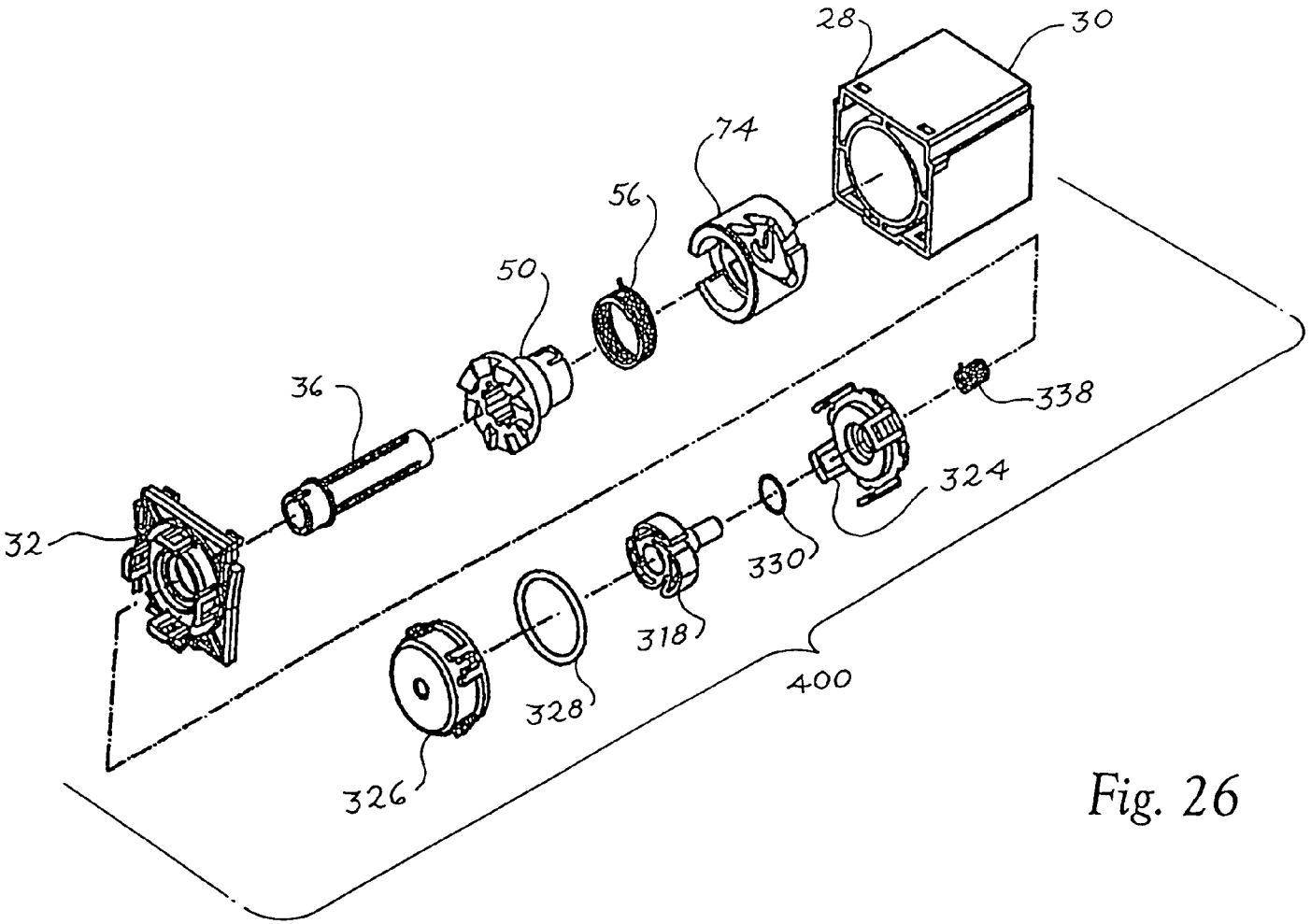
FIG. 26 is an exploded perspective view thereof.
Figure 27:
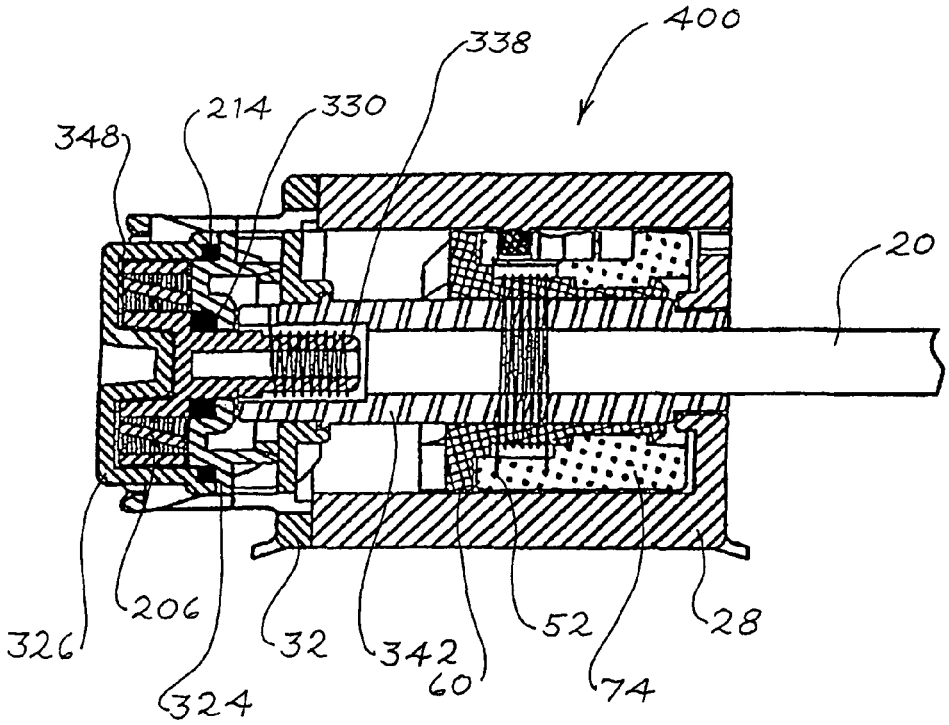
FIG. 27 is a cross-sectional view taken along the line 27-27 of FIG. 25.

Turning now to FIG. 25, a multifunction control mechanism generally indicated at 400 comprises a combination of control module 10 (employed to control the transmission of forces within the module, including locking and unlocking the drive shaft from rotation, during various phases of operation), and control module 312 (that unidirectionally cushions rotation of drive shaft 20). FIG. 26 is an exploded perspective view of control module 400, omitting drive axle 20 which is visible in the cross-sectional view of FIG. 27.

Figure 28:
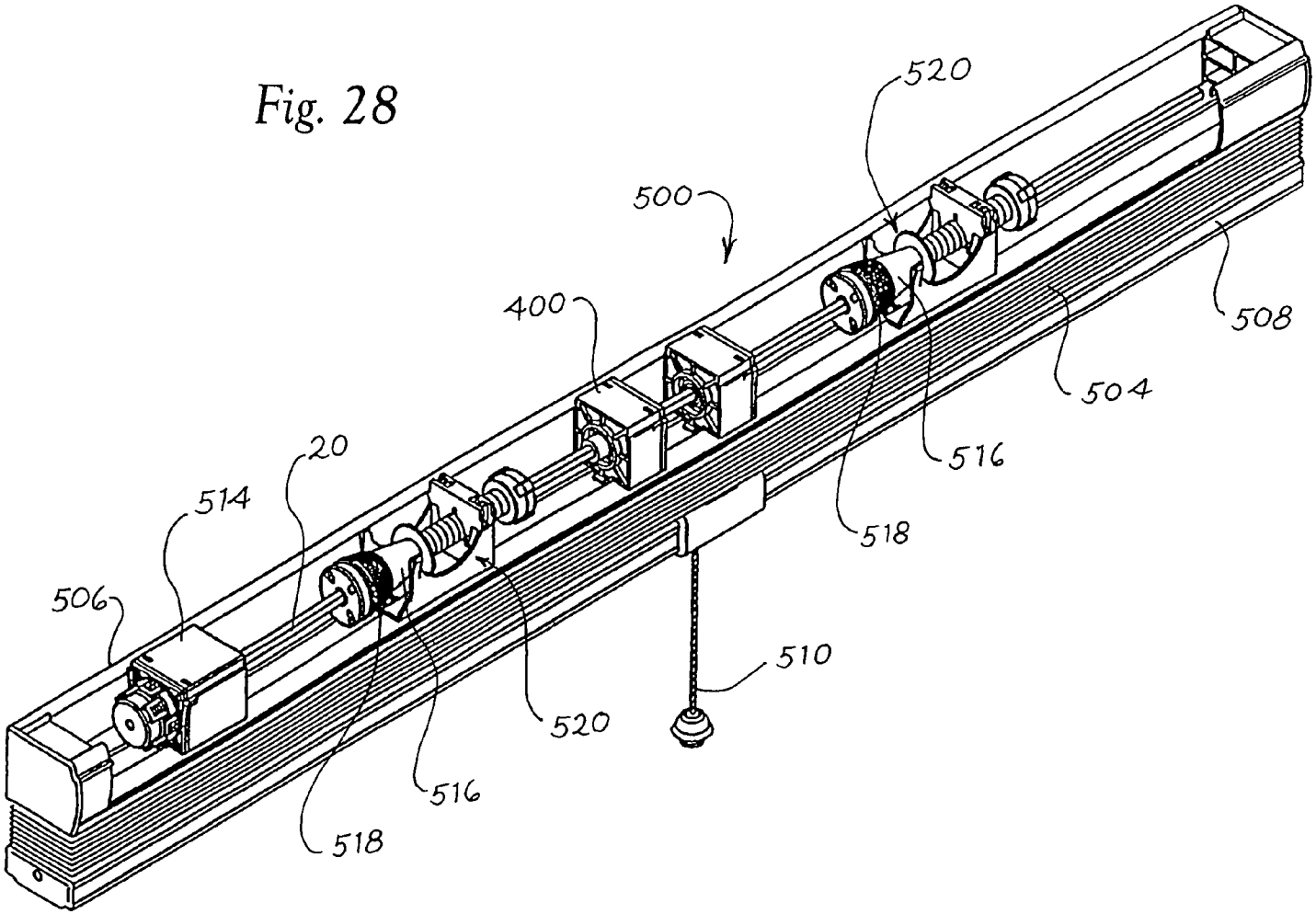
FIG. 28 is a perspective view of a window covering according to the present invention.

FIG. 28 shows a multifunction control mechanism 400 incorporated in a window covering 500 similar to the window covering 10 of commonly assigned U.S. Pat. No. 7,624,785 entitled "Self-Raising Window Covering" that issued Dec. 1, 2009, and which is herein incorporated by reference. The window covering 500 includes a shade element 504 in the form of a Venetian blind disposed between a head rail 506 and a bottom rail 508. A pull cord 510 is used to lower the shade element.

Drive shaft 20 extends along the multifunction control mechanism 400 and a pair of drive units or spring drives 514. A pair of cord winding assemblies having winding drums 516 wind raising cords 518 to retract and extend the shade element 504. The retraction of the shade element is cushioned by the cushioning portion of control mechanism 400. Retraction and extension of the shade element is automatic, or hands-free, owing to the transmission control portion of control mechanism 400. If desired, the other control mechanisms herein may be substituted for the control mechanism 400.

The foregoing descriptions and the accompanying drawings are illustrative of the present invention. Still other variations and arrangements of parts are possible without departing from the spirit and scope of this invention.

What is claimed is:

1. A control mechanism adapted for use with a window covering that has a head rail, a bottom member, and a shade element arranged between a head rail and a bottom member, the control mechanism comprising:

a drive axle defining a longitudinal axis and operable to rotate for raising and lowering the bottom member;

a fixed housing including a sidewall and a key member, the sidewall including a first gripping structure;

a clutch module assembled within the housing and connected with the key member, wherein the clutch module comprises a coupling element, an end surface of the coupling element includes a second gripping structure that axially faces the first gripping structure, and a hole for assembling the drive axle through the coupling element, the coupling element and the second gripping structure being rotationally dependent of the drive axle and movable in unison along the drive axle, the coupling element further being movable with the second gripping structure along the drive axle between a first position and a second position driven by the rotation of the drive axle, wherein the first and second gripping structures are axially spaced apart from each other and rotation of the drive axle is permitted when the coupling element is in the first position, and the first and second gripping structures contact and axially engage with each other and rotation of the drive axle is blocked when the coupling element is in the second position; and a reciprocator disposed adjacent to the coupling element, the reciprocator defining a guide track interacting with the key member, wherein rotation of the reciprocator causes relative movement of the key member along the guide track so as to cause axial movement of the coupling element and the second gripping structure with respect to the drive axle between the first and second positions.

2. The control mechanism according to claim 1, wherein:

the reciprocator is driven in rotation by the coupling element and includes a guide track engaged with the key member, and rotation of the reciprocator causes relative movement of the key member in the guide track so as to cause axial movement of the coupling element and the second gripping structure with respect to the drive axle.

3. The control mechanism according to claim 2, wherein rotation of the coupling element is transmissible to the reciprocator via a locking arrangement between the coupling element and the reciprocator, the locking arrangement being operable to decouple the reciprocator from the coupling element and allow rotation of the coupling element in a first direction when abutment of the key member with a portion of the guide track blocks rotation of the reciprocator in the first direction.

4. The control mechanism according to claim 3, wherein the locking arrangement comprises a coil spring mounted between the reciprocator element and the coupling element, wherein the coil spring is mounted around the coupling element and has an end portion connected with the reciprocator element.

5. The control mechanism according to claim 3, wherein the guide track includes a plurality of turn regions engageable with the key member for stopping the reciprocator element at different positions along the drive axle.

6. The control mechanism according to claim 5, wherein the first and second gripping structure engage with each other when the key is engaged with a first turn region.

7. The control mechanism according to claim 6, wherein rotation of the drive axle in a second direction opposite the first direction is transmitted from the coupling element via the locking arrangement to the reciprocator to cause the key to engage a second turn region opposite the first turn region and cause the second gripping structure to axially move away from the first gripping structure.

8. The control mechanism according to claim 7, wherein further rotation of the drive axle in the second direction while the key is engaged in the second turn region causes the locking arrangement to unlock the coupling element such that the coupling element is allowed to rotate along with the drive axle relative to the reciprocator element.

9. The control mechanism according to claim 2, wherein the second gripping structure includes a plurality of cogs that are disposed radial relative to the longitudinal axis on the end surface of the coupling element facing the sidewall of the housing.

10. The control mechanism according to claim 9, wherein the first gripping structure includes a plurality of matching cogs adapted to engage with the cogs of the second gripping structure.

11. The control mechanism according to claim 1, wherein the sidewall of the housing includes a hole allowing the drive axle to extend on an outer side of the sidewall that is opposite the first gripping structure.

12. The control mechanism according to claim 11, wherein the outer side of the sidewall includes a fastening member attaching a cushion device with the housing.

13. The control mechanism according to claim 12, wherein the cushion device comprises:

a casing;

a rotor configured to lock with the drive axle in rotation, wherein the rotor includes a plurality of radial blades; and a cushion medium in contact with the radial blades for hindering rotation of the rotor.

14. A window covering comprising:

a head rail having a drive axle disposed along a longitudinal rotation axis, the drive axle being operable to rotate about the rotation axis;

a bottom member suspended from the head rail via a cord element;

a shade element suspended between the head rail and the bottom member;

a cord winding module operable to wind and unwind the cord element for respectively raising and lowering the bottom member;

a spring drive unit adapted to rotate the drive axle in a first direction for raising the bottom member; and a clutch module mounted in a housing fixedly secured in the head rail, wherein the housing includes a first gripping structure, and the clutch module comprises a coupling element that is locked and operable to rotate with the drive axle about the rotation axis and is movable along the drive axle, the coupling element including an end surface that has a second gripping structure axially facing the first gripping structure, the end surface further having a hole through which the drive axle is assembled;

wherein the coupling element and the second gripping structure are axially movable along the drive axle toward the first gripping structure on the housing when the drive axle rotates in the first direction, until the second gripping structure contacts and engages with the first gripping structure for blocking rotation of the drive axle in the first direction, and the clutch module is movable along the drive axle to axially disengage the second gripping structure from the first gripping structure when the drive axle rotates in a second direction opposite the first direction.

15. The window covering according to claim 14, wherein the second gripping structure includes a plurality of cogs that are disposed radial relative to the rotation axis on the end surface of the coupling element facing the first gripping structure on the housing.

16. The window covering according to claim 15, wherein the first gripping structure includes a plurality of matching cogs adapted to engage with the cogs of the second gripping structure.

17. The window covering according to claim 14, wherein the first gripping structure is formed on an inner side of a sidewall of the housing, the sidewall including a hole allowing the drive axle to extend on an outer side of the sidewall that is opposite the first gripping structure.

18. The window covering according to claim 17, wherein the outer side of the sidewall includes a fastening member that attaches a cushion device with the housing.

19. The window covering according to claim 18, wherein the cushion device comprises:

a casing;

a rotor configured to lock with the drive axle in rotation, wherein the rotor includes a plurality of radial blades; and a cushion medium in contact with the radial blades for hindering rotation of the rotor.

20. The window covering according to claim 14, wherein the clutch module further comprises:

a reciprocator element pivotally mounted around the coupling element and locked with the coupling element in sliding movement along the drive axle; and a coil spring mounted between the reciprocator element and the coupling element, wherein the coil spring is mounted tightly around the coupling element and has an end portion connected with the reciprocator element.

* * * * *